US009886830B2

(12) United States Patent
Ito et al.

(10) Patent No.: US 9,886,830 B2
(45) Date of Patent: Feb. 6, 2018

(54) ARTICLE MANAGEMENT SYSTEM

(71) Applicant: TOSHIBA TEC KABUSHIKI KAISHA, Shinagawa-ku, Tokyo (JP)

(72) Inventors: Kenji Ito, Tokyo (JP); Masami Yamanashi, Shizuoka (JP); Shinichi Kashiwagi, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/992,159

(22) Filed: Jan. 11, 2016

(65) Prior Publication Data

US 2016/0217667 A1 Jul. 28, 2016

(30) Foreign Application Priority Data

Jan. 26, 2015 (JP) ..... 2015-012331

(51) Int. Cl.
*G08B 13/14* (2006.01)
*G08B 13/24* (2006.01)
*G08B 25/10* (2006.01)

(52) U.S. Cl.
CPC ..... *G08B 13/2462* (2013.01); *G08B 25/10* (2013.01)

(58) Field of Classification Search
CPC ..... G08B 13/2452; G08B 25/10
USPC ..... 340/572.1–572.9, 10.1–10.5, 5.1–5.5
See application file for complete search history.

(56) References Cited

U.S. PATENT DOCUMENTS 4,920,334 A * 4/1990 DeVolpi ..... B62H 3/04 340/427
4,956,982 A * 9/1990 Valley ..... E05B 67/383 70/18
2006/0077038 A1* 4/2006 Hopkins ..... G07C 9/00142 340/5.73
2010/0026452 A1* 2/2010 Wilms ..... G07F 17/12 340/5.73
2012/0062362 A1* 3/2012 Rudduck ..... G07F 17/12 340/5.64

(Continued)

FOREIGN PATENT DOCUMENTS

JP 2002-138727 5/2002
JP 2008-152686 7/2008

(Continued)

OTHER PUBLICATIONS

Japanese Office Action for Japanese Patent Application No. 2015-012331 dated Jun. 27, 2017.

*Primary Examiner* — Ojiako Nwugo
(74) *Attorney, Agent, or Firm* — Amin, Turocy & Watson LLP

(57) ABSTRACT

An article management system comprises a medium in which unique identification information is recorded, a reader for reading the identification information recorded on the medium, an alarm, which is to be attached to an article deposited by a user, for carrying out a notification operation in response to input of a driving signal, and an article management apparatus including an association module configured to associate the medium with the alarm attached to the article to be handed over to the user who carries the medium and an output module configured to output the driving signal to the alarm associated with the medium of which the identification information is read by the reader.

9 Claims, 10 Drawing Sheets

(56) References Cited

U.S. PATENT DOCUMENTS

| | | | | |
|---|---|---|---|---|
| 2013/0132440 | A1* | 5/2013 | Carlson | G06Q 10/06 707/792 |
| 2015/0246735 | A1* | 9/2015 | Roux | B64F 1/366 700/227 |
| 2016/0029168 | A1 | 1/2016 | Kambe et al. | |

FOREIGN PATENT DOCUMENTS

| | | |
|---|---|---|
| JP | 2010-023952 | 2/2010 |
| JP | 2013-203493 | 10/2013 |
| JP | 2016-031539 | 3/2016 |

* cited by examiner

FIG.2

200

| INTENSITY OF RADIO WAVE (db) | DISTANCE (m) |
|---|---|
| A1 | B1 |
| A2 | B2 |
| A3 | B3 |
| A4 | B4 |
| A5 | B5 |
| ⋮ | ⋮ |

FIG.3

300

| USER ID | ALARM ID | DEPOSIT DATE AND TIME |
|---|---|---|
| C099 | D156 | YYYYMMDDhhmm |
| C123 | D058 | YYYYMMDDhhmm |
| C025 | D333 | YYYYMMDDhhmm |
| C087 | D027 | YYYYMMDDhhmm |
| C001 | D014 | YYYYMMDDhhmm |
| ⋮ | ⋮ | ⋮ |

FIG.4

400

| USER ID | RECORDED INTENSITY Am | DISTANCE Dn | DISPLAY FLAG F1 | NOTIFICATION FLAG F2 |
|---|---|---|---|---|
| | | | | |
| | | | | |
| | | | | |
| | | | | |
| | | | | |

ARTICLE MANAGEMENT SYSTEM

CROSS-REFERENCE TO RELATED APPLICATION

This application is based upon and claims the benefit of priority from Japanese Patent Application No. 2015-012331, filed Jan. 26, 2015, the entire contents of which are incorporated herein by reference.

FIELD

Embodiments described herein generally relate to an article management system for managing an article such as a baggage and the like deposited by a user.

BACKGROUND

In an article checkroom for keeping an article, for example, baggage, when a user who has deposited baggage comes to a window, a person in charge looks for the baggage deposited by the user. Thus, it takes much time to hand over the baggage and an improvement is desired.

DESCRIPTION OF THE DRAWINGS

FIG. 2 is a schematic diagram illustrating a conversion table;

FIG. 3 is a schematic diagram illustrating an association file;

FIG. 4 is a schematic diagram illustrating a tracking file;

DETAILED DESCRIPTION

According to an embodiment, an article management system comprises a medium on which unique identification information is recorded, a reader configured to read the identification information recorded on the medium, an alarm, which is to be attached to an article deposited by a user, configured to execute a notification operation in response to input of a driving signal, and an article management apparatus. The article management apparatus comprises an association module configured to associate the medium with the alarm attached to the article to be handed over to the user who carries the medium and an output module configured to output the driving signal to the alarm associated with the medium of which the identification information is read by the reader.

Hereinafter, an article management system of the embodiment used to reduce the time spent in handing over an article to achieve a high efficiency of the job is described with reference to the accompanying drawings. The present embodiment exemplifies an article management system established in an article checkroom at which a user, e.g., a traveler temporarily deposits an article such as baggage.

First Embodiment

Figure 1:
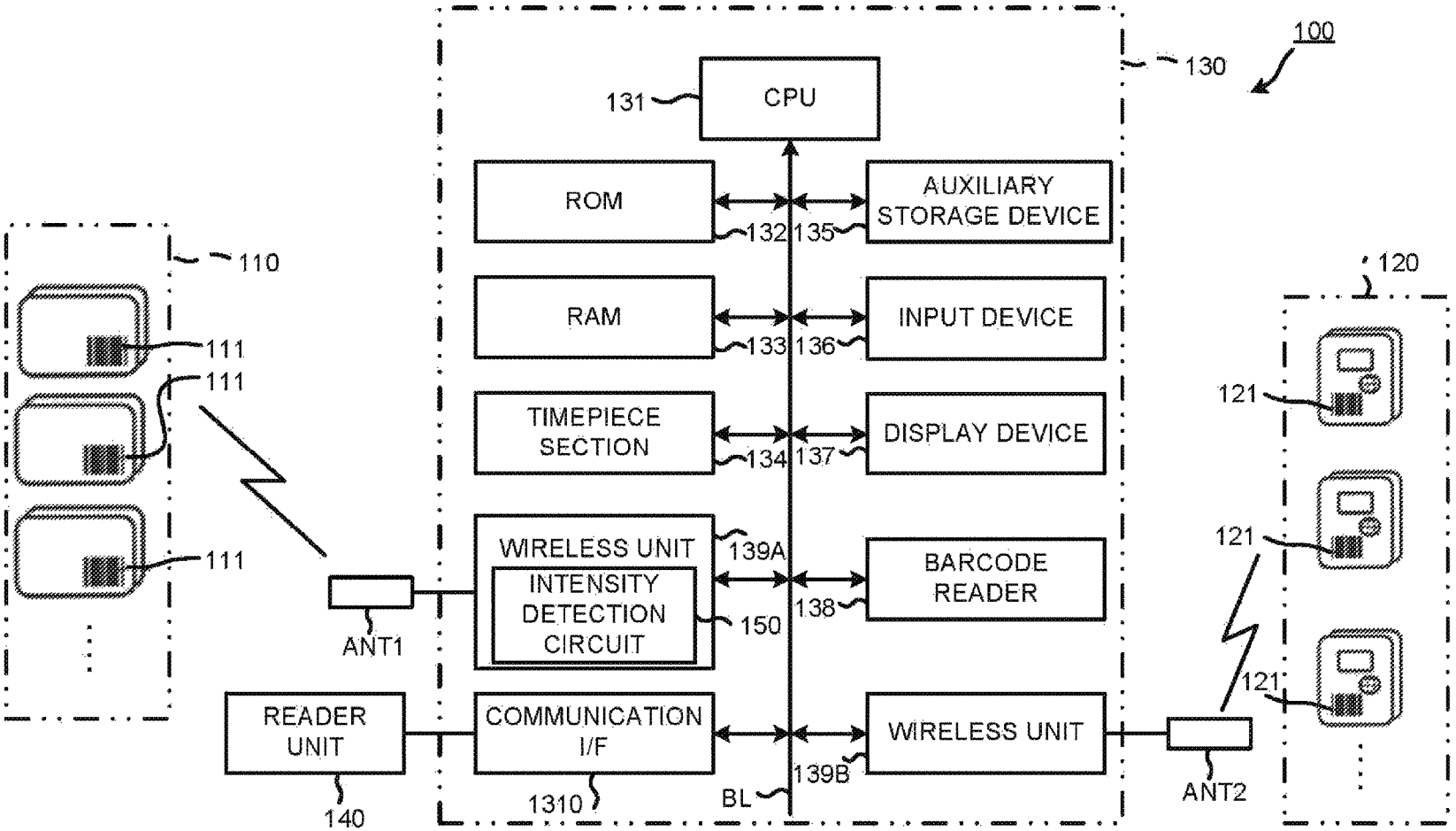
FIG. 1 is a schematic diagram illustrating the whole constitution of an article management system.

FIG. 1 is a schematic diagram illustrating the whole constitution of an article management system 100. The article management system 100 includes a plurality of transmitters 110, a plurality of alarms 120, an article management apparatus 130, and a reader unit 140.

The transmitter 110 uses a wireless PAN (Personal Area Network) represented by Bluetooth (registered trademark), ZigBee (registered trademark) and the like or a wireless LAN (Local Area Network) to transmit a beacon signal continuously or periodically. A unique ID of the transmitter 110 is contained in the beacon signal.

The transmitter 110, a plurality of which is prepared at the window of the article checkroom, is handed over to a user who deposits baggage. The user carries the transmitter 110 during a period of depositing the baggage, and returns the transmitter 110 in exchange with the baggage at the time of receiving the deposited baggage. A barcode 111 representing the ID (hereinafter referred to as a user ID) of the transmitter 110 is attached to the transmitter 110.

The alarm 120 executes a notification operation if a driving signal including a unique ID (hereinafter, referred to as an alarm ID) for the alarm 120 is received. The driving signal is transmitted from the article management apparatus 130. The notification operation refers to both a light emitting operation from a light source and a sounding operation from a sound source. The notification operation may be executed in such a manner that only the light emitting operation is executed at first and then the sounding operation is executed after a given period of time elapses, or in such a manner that only the sounding operation is executed at first and then the light emitting operation is executed after a given period of time elapses. The notification operation stops through, for example, turning off a manual switch. After stopping, the notification operation is not executed until the manual switch is reset.

The alarm 120, a plurality of which is prepared at the window of the article checkroom, is attached to the baggage deposited by the user. If the user deposits more than two pieces of baggage, all the baggage is gathered up to one location and one of them is attached with the alarm 120. The alarm 120 is not attached to the baggage but may be placed at a location where the baggage is kept. A barcode 121 representing the alarm ID is attached to the alarm 120.

The article management apparatus 130 includes a CPU (Central Processing Unit) 131, a ROM (Read Only Memory) 132, a RAM (Random Access Memory) 133, a timepiece section 134, an auxiliary storage device 135, an input device 136, a display device 137, a barcode reader 138, a first wireless unit 139A, a second wireless unit 139B and a communication interface 1310. Further, in the article management apparatus 130, the CPU 131 is connected with the ROM 132, the RAM 133, the timepiece section 134, the auxiliary storage device 135, the input device 136, the display device 137, the barcode reader 138, the first wireless unit 139A, the second wireless unit 139B and the communication interface 1310 through a bus line BL such as an address bus line, a data bus line and the like.

The CPU 131 acting as a central part of a computer controls each section to realize various functions of the article management apparatus 130 according to an operating system and application programs.

The ROM 132 acting as a main memory part of the computer stores the operating system and application programs. There is a case in which the ROM 132 stores data required by the CPU 131 to execute processing for controlling each section.

The RAM 133 acting as a main memory part of the computer stores data required by the CPU 131 to execute the processing. Further, the RAM 133 is also used as a work area in which data is rewritten by the CPU 131.

The timepiece section 134 counts the system clock (date and time) of the computer as the current date and time.

The auxiliary storage device 135 acting as an auxiliary storage part of the computer is, for example, an EEPROM (Electric Erasable Programmable Read-Only Memory), an HDD (Hard Disc Drive) or an SSD (Solid State Drive). The auxiliary storage device 135 stores data used for executing various processing by the CPU 131 and data generated in the processing executed by the CPU 131. The auxiliary storage device 135 may also store application programs.

The input device 136 receives an instruction input by an operator. The display device 137 displays various screens. For example, a keyboard, a mouse and the like can be used as the input device 136. For example, a liquid crystal display can be used as the display device 137. A touch panel may be used to integrate the input device 136 with the display device 137.

The barcode reader 138 optically reads the barcodes 111 and 121 attached to the transmitter 110 and the alarm 120, respectively.

The first wireless unit 139A is connected with an antenna ANT1, and a radio wave propagation area of the antenna ANT1 is referred to as a wireless communication area. The first wireless unit 139A receives the beacon signal transmitted from the transmitter 110 located in the wireless communication area. The antenna ANT1 is arranged nearby the window of the article checkroom. The article management apparatus 130 can widely set the wireless communication area in a direction of directivity of the antenna ANT1 from the window acting as a reference with the use of the antenna ANT1 having directivity. The article management apparatus 130 can set the wireless communication area concentrically from the window acting as a center with the use of the antenna ANT1 having non-directivity. The antenna ANT1 and the first wireless unit 139A function as a receiver which receives radio wave wirelessly sent from the transmitter 110. The first wireless unit 139A includes an intensity detection circuit 150 which detects the intensity of the radio wave (db) received with the antenna ANT1.

The second wireless unit 139B is connected with the antenna ANT2 and a radio wave propagation area of the antenna ANT2 is referred to as a wireless communication area. The second wireless unit 139B transmits a driving signal to the alarm 120 located in the wireless communication area. Other than a general antenna, for example, a leaky coaxial cable laid at the ceiling of a place for baggage can be applied as the antenna ANT2.

The communication interface 1310 carries out data communication with the reader unit 140 according to a prescribed communication protocol.

The article management apparatus 130 with such a constitution may be a computer such as a personal computer or a tablet terminal. If such a computer is applied as the article management apparatus 130, the barcode reader 138 is connected with the article management apparatus 130 through an interface for peripheral devices such as a USB and the like. The article management apparatus 130 (computer) is located at or nearby the window of the article checkroom.

The reader unit 140 is mounted on a wall or a pillar at a location at a predetermined distance, for example, 30 meters, away from the window of the article checkroom. The reader unit 140 reads the user ID of the transmitter 110. The reader unit 140 includes a scanner capable of reading the barcode 111 and an interface for transmitting the user ID obtained from the read barcode 111 to the communication interface 1310.

In a case in which a short distance wireless communication element, which is referred to as, for example, an RFID (Radio Frequency Identification) tag or an NFC (Near Field Communication) tag, is contained in the transmitter 110, the reader unit 140 may comprise an RFID tag reader, or an NFC tag reader, instead of the scanner. The reader unit 140 may read the user ID transmitted from the transmitter 110 using the short distance wireless communication. The number of the reader units 140 is not limited to one. A plurality of the reader units 140 may be connected with the communication interface 1310 in parallel.

The article management apparatus 130 includes three job modes, i.e., a deposit job, a tracking job and a monitoring job. The article management apparatus 130 can execute the three jobs in parallel. The three jobs are controlled by respectively different application programs.

Further, a conversion table 200 shown in FIG. 2, an association file 300 shown in FIG. 3 and a tracking file 400 shown in FIG. 4 are required for the article management apparatus 130 to execute each job.

The conversion table 200 is a data table used for converting intensity of radio wave (db) at the time of receiving the radio wave from the transmitter 110 by the antenna ANT1 into a relative distance (m) between the transmitter 110 and the antenna ANT1. For example, at the time the article management system 100 is introduced, the relative distance (m) is experimentally calculated with respect to the intensity of radio wave (db) and the calculated data is set in the conversion table 200. The conversion table 200 is stored in the ROM 132 or the auxiliary storage device 135.

The association file 300 is a data file for recording a plurality of records each of which consists of the user ID, the alarm ID and deposit date and time. The association file 300 is formed in the auxiliary storage device 135 or the RAM 133.

The tracking file 400 is a data file for recording a plurality of records each of which consists of the user ID, the intensity of radio wave Am (db), the distance Dn (m), a display flag F1 and a notification flag F2. The tracking file 400 is formed in the auxiliary storage device 135 or the RAM 133. Each record in the tracking file 400 may further record an alarm ID associated with the user ID.

Figure 5:
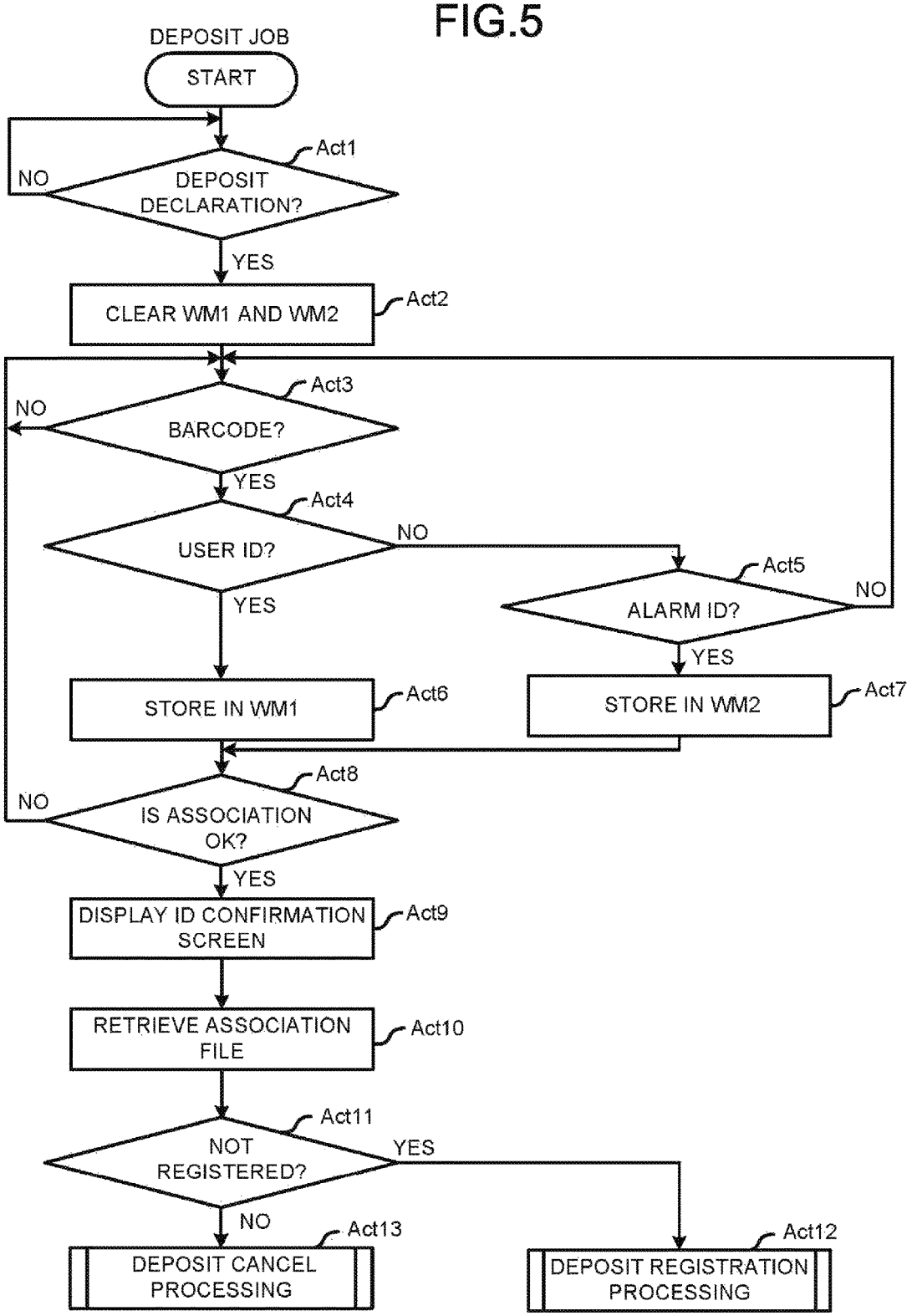
FIG. 5 is a flowchart illustrating processing procedures of a deposit job.

Hereinafter, all the jobs are described in order. First, the deposit job is described with reference to the flowcharts shown in FIG. 5 and FIG. 6.

An application program for controlling the deposit job is started if the article management apparatus 130 starts. If the application program is started, the CPU 131 starts the procedures of processing in the flowchart shown in FIG. 5. First, the CPU 131 waits for a deposit declaration (Act 1). If the input device 136 is a keyboard, the CPU 131 waits for input of a deposit declaration key allocated on the keyboard. If the input device 136 is a mouse, the CPU 131 waits for a click on an icon 'deposit declaration' displayed on the display device 137.

If the user who wants to deposit the baggage comes to the window, a person in charge of the window operates the input device 136 to input the deposit declaration by pressing the deposit declaration key or clicking the icon 'deposit declaration'. In this way, if the deposit declaration is received (Yes in Act 1), the CPU 131 clears a pair of work memories WM1 and WM2 formed in the RAM 133 (Act 2).

The CPU 131 stands by until the barcode data is input (Act 3). If the barcode is read by the barcode reader 138 (Yes in Act 3), the CPU 131 identifies whether the barcode data is the user ID or the alarm ID (Act 4 and Act 5). Different category flags are incorporated into the user ID attached to each transmitter 110 and the alarm ID attached to each alarm 120, respectively. The CPU 131 identifies whether the barcode data is the user ID or the alarm ID through recognizing the category flag.

If the barcode data is neither the user ID nor the alarm ID (No in Act 4 and No in Act 5), the CPU 131 stands by until the next barcode data is input (Act 3).

The person in charge of the window who carries out a deposit declaration takes out one transmitter 110 to be handed over to the user in exchange of the baggage. Then, the person in charge operates the barcode reader 138 to read the barcode 111 attached to the transmitter 110. If the barcode data is the user ID (Yes in Act 4), the CPU 131 stores the user ID in the work memory WM1 (Act 6).

Similarly, the person in charge of the window who carries out the deposit declaration takes out one alarm 120 to be attached to the baggage deposited by the user. The person in charge operates the barcode reader 138 to read the barcode 121 attached to the alarm 120. If the barcode data is the alarm ID (Yes in Act 5), the CPU 131 stores the alarm ID in the work memory WM2 (Act 7).

The CPU 131 confirms whether or not the user ID is associated with the alarm ID (Act 8). If the user ID and the alarm ID are stored in the pair of work memories WM1 and WM2 correspondingly, the CPU 131 determines that the user ID is associated with the alarm ID. If only one of the user ID and the alarm ID is stored, the CPU 131 determines that the user ID is not associated with the alarm ID. If the user ID is not associated with the alarm ID (No in Act 8), the CPU 131 stands by until the next barcode data is input (Act 3).

If the user ID is associated with the alarm ID (Yes in Act 8), the CPU 131 displays an ID confirmation screen 500 (refer to FIG. 9) on the display device 137 (Act 9).

Figure 9:
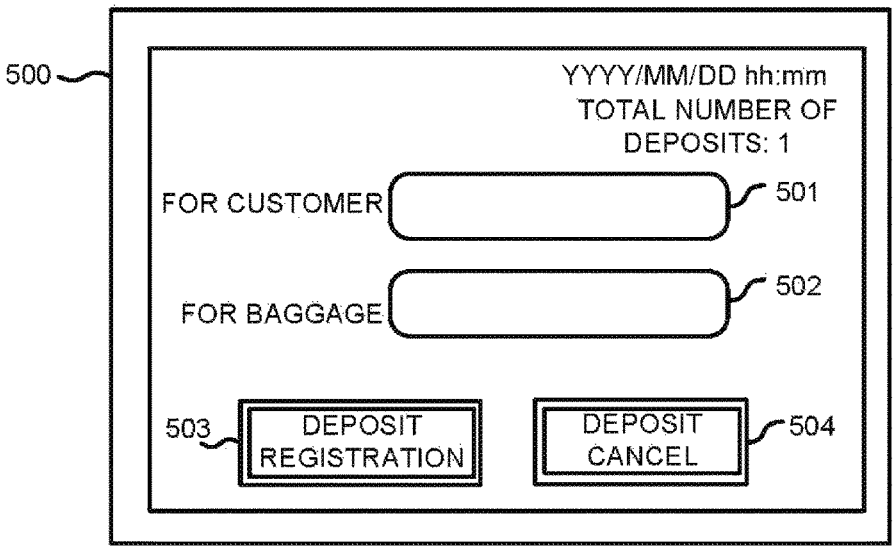
FIG. 9 is a schematic diagram illustrating an example of an ID confirmation screen.

FIG. 9 is an example of the ID confirmation screen 500. As shown in FIG. 9, the ID confirmation screen 500 includes a display area for customer 501, a display area for baggage 502, a deposit registration button 503 and a deposit cancellation button 504 as display components.

The CPU 131 displays the user ID stored in the work memory WM1 in the display area for customer 501. The CPU 131 displays the alarm ID stored in the work memory WM2 in the display area for baggage 502. At this time, the CPU 131 disables the deposit registration button 503 and the deposit cancellation button 504. Thus, even if the person in charge of the window desires to operate the input device 136 to input either of buttons 503 and 504, the input operation cannot be executed.

After displaying the ID confirmation screen 500, the CPU 131 retrieves the association file 300 (Act 10). The CPU 131 confirms whether or not a record containing the user ID stored in the work memory WM1 and the alarm ID stored in the work memory WM2 is registered in the association file 300 (Act 11). If the record is not registered (Yes in Act 11), the CPU 131 executes a deposit registration processing (Act 12). If the record is registered (No in Act 11), the CPU 131 executes the deposit cancellation processing (Act 13).

Figure 6:
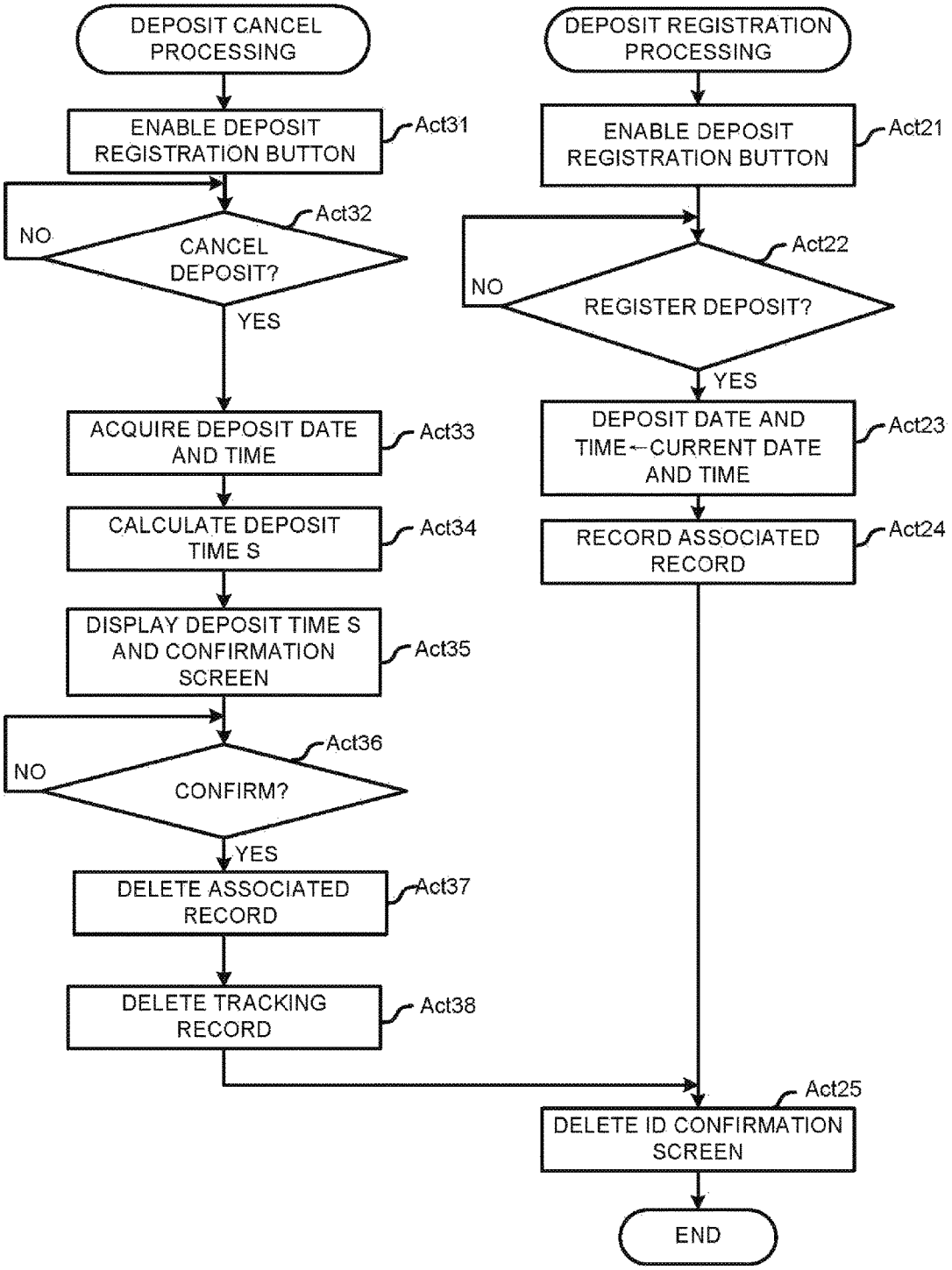
FIG. 6 is a flowchart illustrating procedures of a deposit registration processing and a deposit cancellation processing.

Procedures of the deposit registration processing and the deposit cancellation processing are disclosed with the flowchart shown in FIG. 6. If the deposit registration processing is executed, the CPU 131 enables the deposit registration button 503 on the ID confirmation screen 500 first (Act 21). Then the CPU 131 stands by until the deposit registration button 503 is operated (Act 22).

The person in charge of the window who reads the barcode 111 of the transmitter 110 and the barcode 121 of the alarm 120 with the barcode reader 138 confirms that each barcode is read correctly from the ID confirmation screen 500. After confirming, the person in charge of the window operates the input device 136 to input the deposit registration button 503.

If the deposit registration button 503 is input, the CPU 131 acquires the data of date and time clocked by the timepiece section 134 as the date and time of depositing the baggage by the user (Act 23). The CPU 131 records the user ID in the work memory WM1, the alarm ID in the work memory WM2 and the data of deposit date and time acquired by the processing in Act 23 as one record in the association file 300 (Act 24: association module). Then, the CPU 131 erases the ID confirmation screen 500 (Act 25). In this way, the deposit registration processing is ended.

If the deposit cancellation processing is executed, the CPU 131 enables the deposit cancellation button 504 on the ID confirmation screen 500 (Act 31). Then the CPU 131 stands by until the deposit cancellation button 504 is operated (Act 32).

If the user who has deposited the baggage comes for receiving the baggage, the person in charge of the window reads the barcode 111 of the transmitter 110 received from the user and the barcode of the alarm. 120 attached to the baggage deposited by the user with the barcode reader 138. The person in charge of the window inputs, if it is confirmed that each barcode is correctly read through the ID confirmation screen 500, the deposit cancellation button 504 by operating the input device 136.

Figure 10:
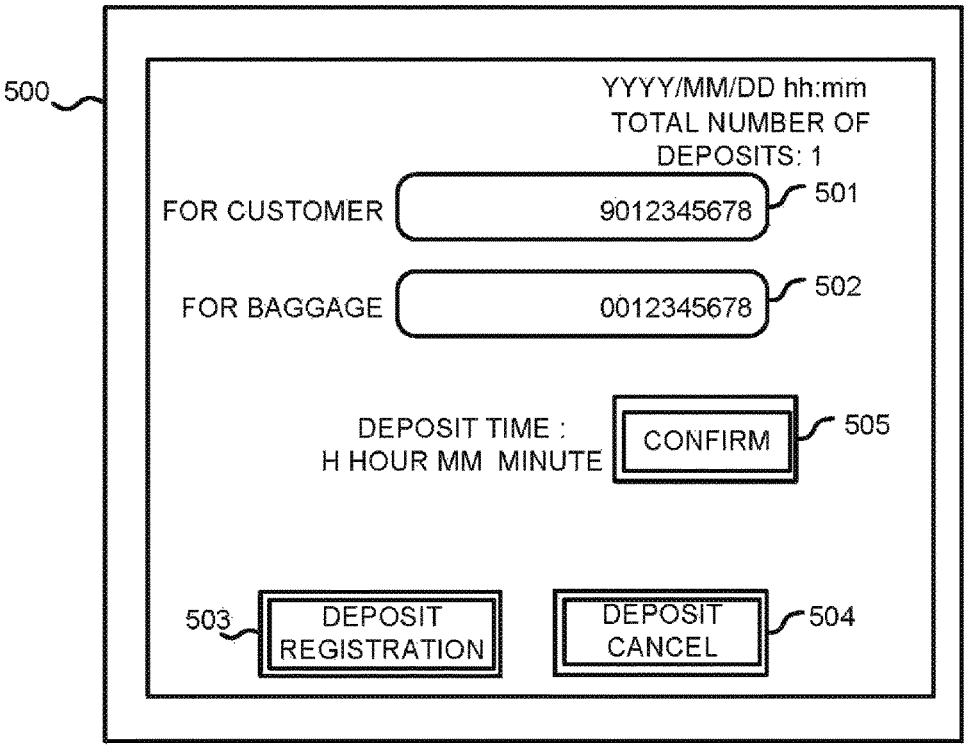
FIG. 10 is a schematic diagram illustrating an example of the ID confirmation screen.

If the deposit cancellation button 504 is input, the CPU 131 acquires the deposit date and time from the record of the association file 300 containing the user ID stored in the work memory WM1 and the alarm ID stored in the work memory WM2 (Act 33). The CPU 131 calculates a deposit time S from the deposit date and time to the current date and time clocked by the timepiece section 134 (Act 34). The CPU 131 displays the deposit time S on the ID confirmation screen 500 together with a confirmation button 505 (Act 35), as shown in FIG. 10. Then the CPU 131 stands by until the confirmation button 505 is input (Act 36).

The person in charge of the window who confirms the deposit time S operates the input device 136 to input the confirmation button 505. If the confirmation button 505 is input (Yes in Act 36), the CPU 131 deletes the record containing the user ID stored in the work memory WM1 and the alarm ID stored in the work memory WM2 from the association file 300 (Act 37). The CPU 131 deletes the record containing the user ID stored in the work memory WM1 from the tracking file 400 (Act 38). Then, the CPU 131 erases the ID confirmation screen 500 (Act 25). In this way, the deposit cancellation processing is ended. The deletion of the record refers to not only the deletion of the record physically, but also the invalidation of the record by setting a deletion flag.

If the deposit registration processing or the deposit cancellation processing is ended, the application program for controlling the deposit job returns to the initial step. The CPU 131 starts the processing procedures shown in the flowchart in FIG. 5 again.

Figure 7:
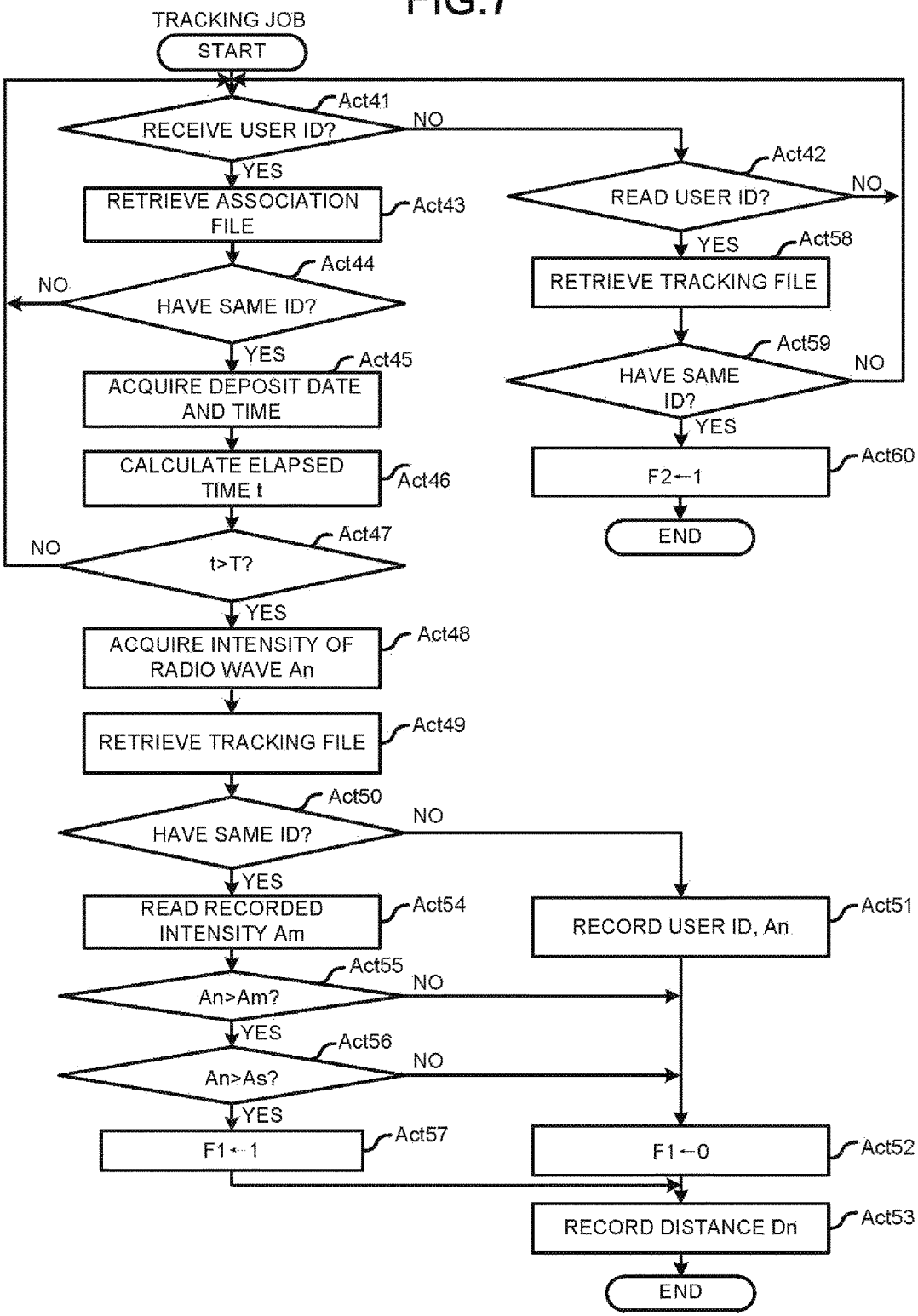
FIG. 7 is a flowchart illustrating procedures of a tracking job.

Next, the tracking job is described with reference to the flowchart shown in FIG. 7.

The application program for controlling the tracking job is started if the article management apparatus 130 starts. If the program is started, the CPU 131 starts the processing procedures shown in the flowchart in FIG. 7. First, the CPU 131 confirms whether or not the user ID is received by the antenna ANT1 (Act 41). If the user ID is not received (No in Act 41), the CPU 131 confirms whether the user ID is read by the reader unit 140 (Act 42). If the user ID is not read (No in Act 42), the CPU 131 confirms whether or not the user ID is received by the antenna ANT1 (Act 41). In this way, the CPU 131 waits for receiving the user ID.

If the user ID transmitted from the transmitter 110 is received through the first wireless unit 139A (Yes in Act 41), the CPU 131 retrieves the association file 300 with the user ID (Act 43). The CPU 131 confirms whether or not the record containing the user ID serving as a retrieval target is registered in the association file 300 (Act 44). If the record is not registered in the association file 300 (No in Act 44), the CPU 131 waits for receiving the user ID again (Act 41, Act 42).

If the record is registered in the association file 300 (Yes in Act 44), the CPU 131 acquires the data of deposit date and time from the record (Act 45). The CPU 131 calculates an elapsed time t from the deposit date and time to the current date and time clocked by timepiece section 134 (Act 46).

The CPU 131 confirms whether or not the elapsed time t is longer than a determination time T (Act 47). The determination time T can be optionally set as long as it is an adequate time for the user who deposits the baggage to move outside of the wireless communication area of the antenna ANT1.

If the elapsed time t is shorter than the determination time T, the received user ID can be regarded as an ID that is transmitted from the transmitter 110 handed over to the user who just deposits the baggage. In this case (No in Act 47), the CPU 131 returns to the standby state for receiving the user ID (Act 41, Act 42).

If the elapsed time t is longer than the determination time T (Yes in Act 47), the received user ID can be regarded as an ID that is transmitted from the transmitter 110 carried by the user who comes to the baggage checkroom to receive the baggage. In this case, the CPU 131 acquires the intensity of radio wave An (db) detected by the intensity detection circuit 150 (Act 48). The CPU 131 retrieves the tracking file 400 with the user ID received through the processing in Act 41 (Act 49). The CPU 131 confirms whether or not the record containing the user ID serving as the retrieval target is registered in the tracking file 400 (Act 50).

If the record is not registered in the tracking file 400 (No in Act 50), the received user ID can be regarded as an ID transmitted from the transmitter 110 carried by the user who just enters the wireless communication area of the antenna ANT1. In this case, the CPU 131 records the record containing the user ID and the intensity of radio wave An (db) in the tracking file 400 (Act 51). The CPU 131 resets the display flag F1 of the record to '0' (Act 52). Further, the CPU 131 refers to the conversion table 200 to convert the intensity of radio wave Am (db) into the relative distance Dn (m) between the transmitter 110 and the antenna ANT1. Then, the CPU 131 records the relative distance Dn (m) in the record (Act 53). In this case, the tracking job for the transmitter 110 of which the user ID is received is ended.

If the record containing the same user ID is registered in the tracking file 400 (Yes in Act 50), the CPU 131 reads the intensity of radio wave Am (db) recorded in the record (Act 54). The CPU 131 compares the intensity of radio wave Am (db) with the intensity of radio wave An (db) acquired through the processing in Act 48 (Act 55: determination module).

If the intensity of radio wave An (db) is smaller than the intensity of radio wave Am (db) (No in Act 55), in other word, in a case in which the intensity of radio wave becomes weak as time elapses, it can be regarded that the user goes increasingly away from the window of the baggage checkroom. In this case, the CPU 131 resets the display flag F1 of the record to '0' (Act 52). The CPU 131 refers to the conversion table 200 to convert the intensity of radio wave Am (db) to the relative distance Dn (m) between the transmitter 110 and the antenna ANT1. The CPU 131 records the relative distance Dn (m) in the record (Act 53). In this way, the tracking job for the transmitter 110 of which the user ID is received is ended.

If the intensity of radio wave An (db) is greater than the intensity of radio wave Am (db) (Yes in Act 55), in other word, in a case in which the intensity of radio wave becomes strong as time elapses, it can be regarded that the user is approaching the window of the baggage checkroom. In this case, the CPU 131 confirms whether or not the intensity of radio wave An (db) is greater than a threshold value As1 (db) (Act 56). The threshold value As1 (db) refers to a normal value of the intensity of radio wave received from the transmitter 110 at the time relative distance between the transmitter 110 and the antenna ANT1 is, for example, 50 m.

If the intensity of radio wave An (db) is smaller than the threshold value As1 (db) (No in Act 56), it can be regarded that the user does not approach a position within a distance of 50 m away from the window. In this case, the CPU 131 resets the display flag F1 of the record containing the received user ID to '0' (Act 52). The CPU 131 refers to the conversion table 200 to convert the intensity of radio wave Am (db) to the relative distance Dn (m) between the transmitter 110 and the antenna ANT1. Then the CPU 131 records the relative distance Dn (m) in the record (Act 53). In this way, the tracking job for the transmitter 110 of which the user ID is received is ended.

If the intensity of radio wave An (db) is greater than the threshold value As1 (db) (Yes in Act 56), it can be regarded that the user is approaching a position within a distance of 50 m away from the window. In this case, the CPU 131 sets the display flag F1 of the record containing the received user ID to '1' (Act 57). The CPU 131 refers to the conversion table 200 to convert the intensity of radio wave Am (db) to the relative distance Dn (m) between the transmitter 110 and the antenna ANT1. The CPU 131 records the relative distance Dn (m) in the record (Act 53). In this way, the tracking job for the transmitter 110 of which the user ID is received is ended.

On the other hand, in a case in which the user ID read by the reader unit 140 is acquired via the communication interface 1310 (Yes in Act 42), the CPU 131 retrieves the tracking file 400 with the user ID (Act 58). Then the CPU 131 confirms whether or not the record containing the user ID serving as the retrieval target is registered in the tracking file 400 (Act 59).

If the record is not registered in the tracking file 400 (No in Act 59), the CPU 131 enters the standby state for the receiving of the user ID again (Act 41, Act 42).

The user operates the reader unit 140 to read the barcode of the transmitter 110 carried by himself/herself before he or she comes to the window at the time the user receives the deposited baggage. Generally, the record containing the user ID serving as the retrieval target is registered in the tracking file 400. If the record is registered in the tracking file (Yes in Act 59), the CPU 131 sets the notification flag F2 of the record containing the user ID to '1' (Act 60). In this way, the tracking job for the transmitter 110 of which the user ID is read by the reader unit 140 is ended.

If the tracking job is ended, the application program for controlling the tracking job is returned to initial step. The CPU 131 starts the processing procedures shown in flowchart in FIG. 7 again.

Figure 8:
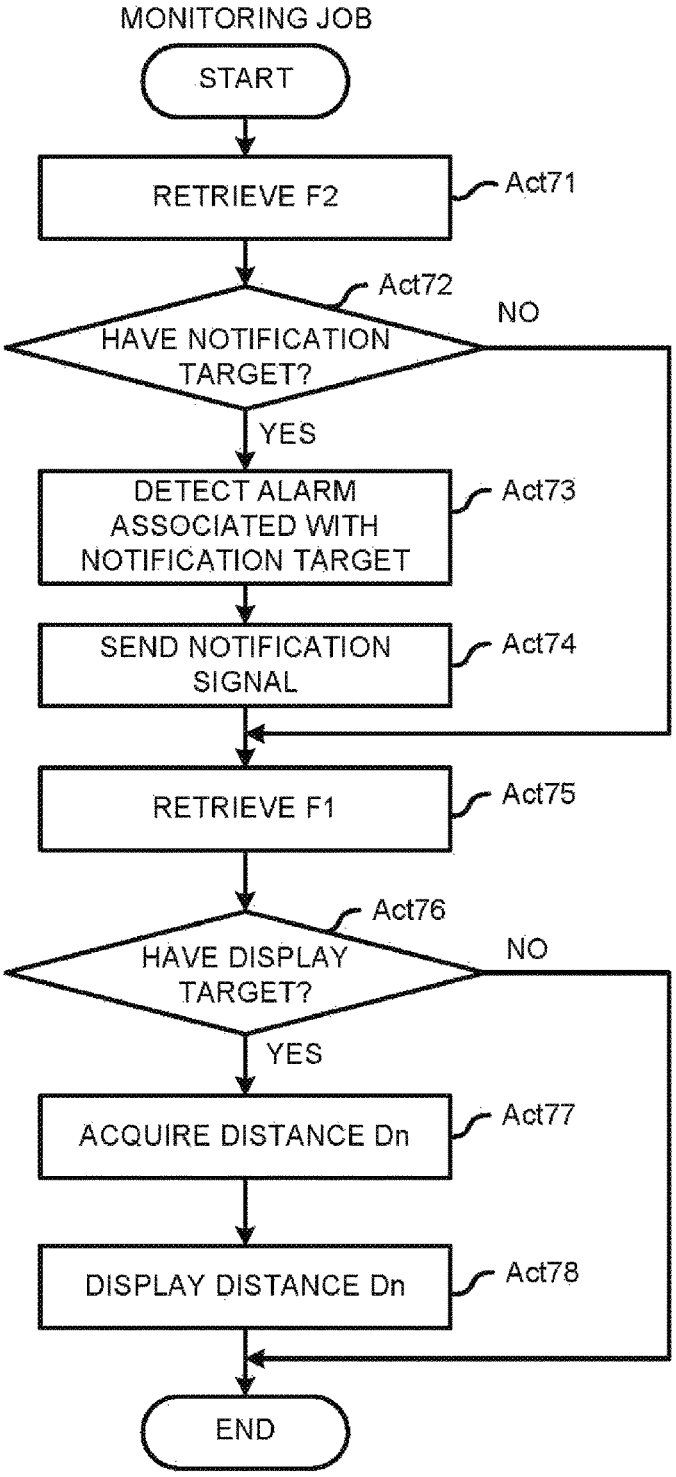
FIG. 8 is a flowchart illustrating the processing procedures of a monitoring job.

Next, the monitoring job is described with reference to FIG. 8.

The application program for controlling the monitoring job is started according to the interruption signal generated at given intervals (e.g. an interval of 1 second). If the program is started, the CPU 131 starts the processing procedures shown in the flowchart of FIG. 8. First, the CPU 131 retrieves the notification flag F2 of each record recorded in the tracking file 400 (Act 71). The CPU 131 confirms whether or not there is a record of which the notification flag F2 is set to '1' (Act 72).

If there is a record of which the notification flag F2 is set to '1' (Yes in Act 72), then the record is a notification target. In this case, the CPU 131 retrieves the association file 300 with the user ID in the record. The CPU 131 detects an alarm ID associated with the user ID (Act 73). The CPU 131 transmits a driving signal containing the alarm ID from the antenna ANT2 through the second wireless unit 139B (Act 74: output module).

If there is a plurality of the records of which notification flags F2 are set to '1' respectively, the CPU 131 retrieves the association file 300 with the user ID of each record to detect all the alarm IDs associated with the user IDs. The CPU 131 transmits driving signals each of which contains each alarm ID in a time-division manner from the antenna ANT2 via the second wireless unit 139B.

The alarm 120 set by the alarm ID carries out a notification operation with light and sound according to transmission of the driving signal containing the alarm ID. The baggage to which the alarm 120 executing the notification operation is attached is the baggage deposited by the user who operates the reader unit 140 to read the user ID. Therefore, the person in charge of the window or the person in charge of the place for baggage looks for the baggage deposited by the user to find the baggage and can carry the baggage out to the window in advance before the user arrives at the window. As a result, the time spent in delivering the baggage at the window is reduced, thereby improving the efficiency of the job at the window.

After the driving signal is transmitted or if there is no record serving as the notification target (No in Act 72), the CPU 131 retrieves the display flag F1 of each record stored in the tracking file 400 (Act 75). The CPU 131 confirms whether or not there is a record of which the display flag F1 is set to '1' (Act 76). If there is no record of which the display flag F1 is set to '1' (No in Act 76), then the monitoring job is ended.

If there is a record of which the display flag F1 is set to '1' (Yes in Act 76), the record is a display target. In this case, the CPU 131 acquires the user ID and the distance Dn from the record. If there is a plurality of the records of which the display flags Fl are set to '1' respectively, the CPU 131 acquires the user ID and the distance Dn from each record (Act 77). The CPU 131 displays, for example, a notification screen 600 having a layout shown in FIG. 11 on the display device 137 based on the data acquired from the tracking file 400 (Act 78: control module). In this way, the monitoring job is ended.

Figure 11:
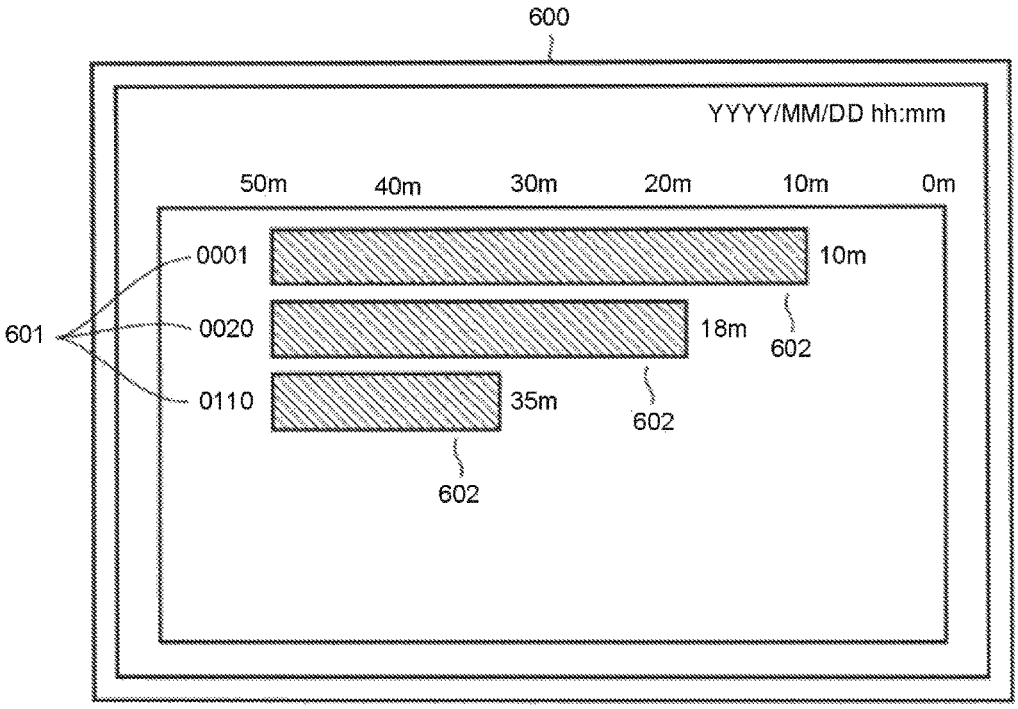
FIG. 11 is a schematic diagram illustrating an example of a notification screen.

As shown in FIG. 11, a user ID 601 and an indicator 602 indicating the distance Dn (m) are displayed on the notification screen 600 in an associated manner. Taking 50 m, corresponding to a threshold value As1(db), which is a relative distance from the antenna ANT1, as a reference value, the distance is displayed in such a manner that the indicator becomes longer as the distance becomes shorter than the reference value. The person in charge of the window or the person in charge of the place for baggage who confirms the notification screen 600 can visually confirm the information, for example, how many users who come to baggage checkroom to receive the baggage and how far the users are away from the window. As a result, if there are many users who come to receive the baggage, the window job can be processed more efficiently by taking proper measures such as increasing the number of the persons in charge of the window to prepare for receiving the users.

Further, the layout of the notification screen 600 is not limited to that shown in FIG. 11. For example, the numerical value of the distance, not the indicator, may be displayed as a distance without any change. The alarm ID associated with the user ID may be displayed instead of displaying the user ID.

The article management system 100 of the present embodiment includes the transmitter 110 the unique user ID of which is recorded as the barcode 111, the reader unit 140 capable of reading the barcode 111, the alarm 120 the unique wireless device ID of which is recorded as the barcode 121 and the article management apparatus 130. The person in charge of the window at the baggage checkroom, when the user comes to deposit a baggage, selects the transmitter 110 to be handed over to the user and the alarm 120 to be attached to the baggage. The person in charge of the window operates the barcode reader 138 of the article management apparatus 130 to read the barcode 111 of the transmitter 110 and the barcode 121 of the alarm 120. In this way, the article management apparatus 130 functions as an association module to associate the user ID decoded from the barcode 111 of the transmitter 110 with the alarm ID decoded from the barcode 121 of the alarm 120. The associated user ID and the alarm ID are registered in the association file 300 as one record.

On the other hand, the user operates the reader unit 140 at the front side of the window to read the barcode 111 of the transmitter 110 before coming to the window to receive the baggage. In this way, the article management apparatus 130 functions as an output module to detect the alarm ID associated with the user ID decoded from the barcode 111 read by the reader unit 140. A driving signal identified with the alarm ID is output to the alarm 120. As a result, the person in charge of the window can quickly specify which one is the baggage of the user who comes to receive baggage because the alarm 120 identified with the alarm ID carries out a notification operation.

Incidentally, the transmitter 110 is equipped with a function of transmitting the beacon signal. The article management apparatus 130 includes the antenna ANT1 for receiving the beacon signal and the first wireless unit 139A. The first wireless unit 139A includes the intensity detection circuit 150 for detecting the intensity of radio wave (db) received by the antenna ANT1. The article management apparatus 130 has a function of determining whether the relative distance between the transmitter 110 that is transmitting the beacon signal and the antenna ANT1 becomes shorter according to the intensity of radio wave of the beacon signal detected by the intensity detection circuit 150. Thus, the article management system 100 can determine whether or not there is a user who is approaching the window of the baggage checkroom to receive the deposited baggage.

The article management apparatus 130 displays, on the display device 137, the notification screen 600 containing the user ID of the transmitter 110 carried by the user if it is determined that the user who is approaching the window is present. The person in charge of the window can specify the user who is approaching the window.

Second Embodiment

The second embodiment is different from the first embodiment in the processing procedures of the monitoring job. The remaining part of the second embodiment is similar to that of the first embodiment, and thus FIG. 1~FIG. 7 and FIG. 9~FIG. 11 are used without any change. Thus, the detailed description thereof is omitted.

Figure 12:
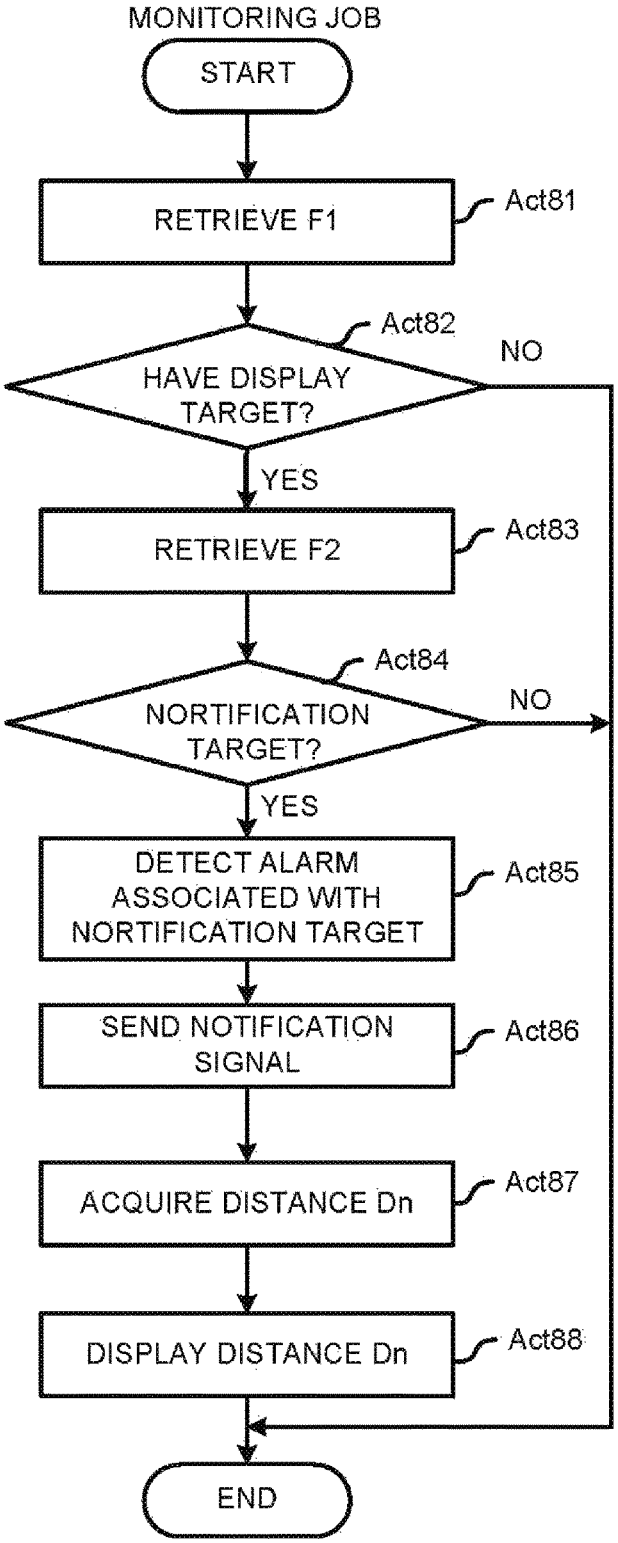
FIG. 12 is a flowchart illustrating processing procedures of the monitoring job according to another embodiment.

FIG. 12 is a flowchart illustrating the processing procedures of the monitoring job in the second embodiment. The application program for controlling the monitoring job is started in response to an interruption signal generated at a given interval (e.g. an interval of 1 second). If the program is started, first, the display flag F1 of each record recorded in the tracking file 400 is retrieved (Act 81). The CPU 131 confirms whether or not there is a record the display flag F1 of which is set to '1' (Act 82). If there is no record the display flag F1 of which is set to '1' (No in Act 82), the monitoring job is terminated.

If there is a record the display flag F1 of which is set to '1' (Yes in Act 82), then the record becomes a display target. In this case, the CPU 131 retrieves the notification flag F2 of each record recorded in the tracking file 400 (Act 83). The CPU 131 confirms whether or not there is a record the notification flag F2 of which is set to '1' (Act 84). If there is no record the notification flag F2 of which is set to '1' (No in Act 84), the monitoring job is terminated.

If there is a record the notification flag F2 of which is set to '1' (Yes in Act 84), the record becomes a notification target. In this case, the CPU 131 retrieves the association file 300 with the user ID of the record. The CPU 131 detects the alarm ID associated with the user ID (Act 85). The CPU 131 transmits a driving signal containing the alarm ID from the antenna ANT2 via the second wireless unit 139B (Act 86: output module).

The CPU 131 acquires the distance Dn and the user ID from the record. At this time, if there is a plurality of records both the display flag F1 and the notification flag F2 of which are set to '1', the user ID and the distance Dn are acquired from each record (Act 87). The CPU 131 displays the notification screen 600 containing the data acquired from the tracking file 400 on the display device 137 (Act 88: control module). In this way, the monitoring job is terminated.

In the second embodiment, the user ID of the user who reads the barcode 111 of the transmitter 110 with the reader unit 140 and the distance between the window and the user are displayed on the notification screen 600. Thus, only the information of the user who actually approaches the window to receive the baggage is displayed on the notification screen 600. Information of a user who occasionally approaches or is present near the window is eliminated.

Further, the present invention is not limited to the foregoing embodiments.

For example, in the foregoing embodiments, the deposit registration button 503 is enabled if the deposit registration processing is executed, and the deposit cancellation button 504 is enabled if the deposit cancellation processing is executed in the deposit job. On this point, for example, the deposit registration button 503 may be displayed on the ID confirmation screen 500 if the deposit registration processing is executed, and the deposit cancellation button 504 may be displayed on the ID confirmation screen 500 if the deposit cancellation processing is executed. Further, although the deposit registration button 503 and the deposit cancellation button 504 are always enabled, it may be determined as an operation error in a case in which the deposit cancellation button 504 is input when the deposit registration processing is executed or the deposit registration button 503 is input when the deposit cancellation processing is executed.

In the foregoing embodiments, the medium on which the user ID is recorded is the transmitter 110. However, the medium is not necessarily equipped with a function of transmitting the radio wave such as the beacon signal. For example, the medium may be a wireless card, a smart phone or a mobile phone which carries a short distance wireless communication element such as an RFID tag or an NFC tag to be capable of reading the user ID with the use of a short distance wireless communication. Alternatively, the medium may also be a portable object (e.g. a card) on which the barcode coded with the user ID is printed.

In the foregoing embodiments, the intensity of radio wave is compared with the threshold value. However, the intensity of radio wave is converted to distance data and the converted distance date may be compared with a threshold value. The method for confirming whether or not the relative distance between the transmitter 110 and the antenna ANT1 becomes shorter than a given distance one after another is not limited to the method in which the radio wave reception intensity is used. It is most important thing in the confirmation method that the relative distance between the transmitter 110 and the antenna ANT1 can be calculated.

In the foregoing embodiments, the first wireless unit 139A and the second wireless unit 139B are arranged; however, these wireless units may be combined to be one. In that case, the communication method may use the existing system such as Bluetooth (registered trademark), while the communication with the transmitter 110 is carried out with a unidirectional communication, and the communication with the alarm 120 is carried out with a bidirectional data communication. It is preferable to use a diversity antenna as the antenna ANT1 in order to ensure the long communication distance with the transmitter 110.

In the foregoing embodiments, a case is exemplified in which the deposit and reception of an article are carried out at the same window; however, it is not limited to this. For example, it is also applicable that an article is deposited at the window of an A location and is received at the window of a B location. At the window of the A location, the transmitter 110 is handed over to the user and the alarm 120 is attached to the article. Then the article is delivered from the A location to the B location. At the window of the B location, in response to the operation in which the user reads the barcode of the transmitter 110 with the reader unit 140 nearby the window, the notification operation by the alarm 120 associated with the transmitter 110 is carried out and therefore the deposition and reception operation can be smoothly performed.

Generally, the transfer of the article management apparatus is carried out in a state of storing programs such as application programs in the ROM; however, it is not limited to this. The programs transferred separately from the computer may be written into the writable storage device included in the computer through the operation of the user. The transfer of the program can be carried out by recording the program in the removable storage medium or communicating via an internet. The storage medium is optional as long as the storage medium, such as a CD-ROM, a memory card and the like, can store programs and can be readable to a device. The functions obtained by installing or downloading the programs may be realized with the cooperation of OS (operating system) inside the device.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is the claim is:

1. An article management system comprising:

a first reader that acquires first identification information of a wireless device carried by a user and second identification information of an alarm associated with an article deposited by the user;

a storage that stores the first identification information and the second identification information acquired by the first reader in an associated manner;

a first communicator that receives a first signal from the wireless device;

a controller that determines a distance from the first communicator to the wireless device based on the first signal received by the first communicator, and displays, on a display, first information indicating the wireless device or the alarm associated with the wireless device and second information indicating the distance to the wireless device if the distance to the wireless device is equal to or less than a predetermined distance;

an interface that acquires the first identification information of the wireless device acquired via a second reader different from the first reader; and a second communicator that transmits a second signal for performing alarm notification to the alarm possessing the second identification information stored in association with the first identification information, if acquiring the first identification information via the interface.

2. The article management system according to claim 1, wherein, if there is a plurality of wireless devices the distance to which is equal to or less than a predetermined distance, the controller displays, on the display, the first information and the second information corresponding to each of the plurality of wireless devices.

3. The article management system according to claim 2, wherein the interface communicates with a plurality of the second readers to acquire the first identification information.

4. The article management system according to claim 1, wherein at least one of the first reader and the second reader is a code reader that reads a code representing the first identification information recorded on the wireless device.

5. The article management system according to claim 1, wherein the second reader is a reader that is compatible with short distance wireless communication and reads the first identification information recorded on the wireless device by short distance wireless communication with a short distance wireless communication element mounted on the wireless device.

6. The article management system according to claim 1, further comprising a second storage that stores a first flag and a second flag in association with the first identification information of the wireless device the distance to which is equal to or less than a predetermined distance, wherein the controller:

changes the first flag stored in association with the first identification information of the wireless device the distance to which is equal to or less than a predetermined distance and becomes shorter, from a first state to a second state;

upon acquiring the first identification information via the interface, changes the second flag stored in association with the first identification information from a third state to a fourth state;

displays, on the display, the first information and the second information corresponding to the wireless device of the first identification information where the first flag is in the second state; and transmits the second information to the alarm possessing the second identification information stored in association with the first identification information where the second flag is in the fourth state.

7. The article management system according to claim 1, further comprising a second storage that stores a first flag and a second flag in association with the first identification information of the wireless device the distance to which is equal to or less than a predetermined distance, wherein the controller:

changes the first flag stored in association with the first identification information of the wireless device the distance to which is equal to or less than a predetermined distance and becomes shorter, from a first state to a second state;

upon acquiring the first identification information via the interface, changes the second flag stored in association with the first identification information from a third state to a fourth state;

displays, on the display, the first information and the second information corresponding to the wireless device of the first identification information where the first flag is in the second state and the second flag is in the fourth state; and transmits the second information to the alarm possessing the second identification information stored in association with the first identification information.

8. A non-transitory storage medium having stored thereon a program readable to a computer system, wherein the program causes the computer system to execute a process routine of: acquiring, via a first reader, first identification information of a wireless device carried by a user and second identification information of an alarm associated with an article deposited by the user, and storing the first identification information and the second identification information in an associated manner; determining, based on a first signal from the wireless device that is received by a first communicator for receiving the first signal, a distance from the first communicator to the wireless device, and displaying, on a display, first information indicating the wireless device or the alarm associated with the wireless device and second information indicating the distance to the wireless device if the distance to the wireless device is equal to or less than a predetermined distance; and transmitting a second signal for performing alarm notification from a second communicator to the alarm possessing the second identification information stored in association with the first identification information, if acquiring the first identification information of the wireless device acquired via a second reader different from the first reader.

9. An article management method, comprising:

acquiring, via a first reader, first identification information of a wireless device carried by a user and second identification information of an alarm associated with an article deposited by the user, and storing the first identification information and the second identification information in an associated manner;

determining, based on a first signal from the wireless device that is received by a first communicator for receiving the first signal, a distance from the first communicator to the wireless device, and displaying, on a display, first information indicating the wireless device or the alarm associated with the wireless device and second information indicating the distance to the wireless device if the distance to the wireless device is equal to or less than a predetermined distance; and transmitting a second signal for performing alarm notification from a second communicator to the alarm possessing the second identification information stored in association with the first identification information, if acquiring the first identification information of the wireless device acquired via a second reader different from the first reader.

* * * * *